US011561024B2

(12) United States Patent
Cunha

(10) Patent No.: US 11,561,024 B2
(45) Date of Patent: Jan. 24, 2023

(54) HANDLE ASSEMBLY FOR ROTATING A PIVOT ROD ATTACHED TO A DAMPER WITHIN DUCTWORK

(71) Applicant: Capital Hardware Supply, Inc., Closter, NJ (US)

(72) Inventor: Joao Maria Ruela Cunha, Closter, NJ (US)

(73) Assignee: CAPITAL HARDWARE SUPPLY, LLC, Closter, NJ (US)

( * ) Notice: Subject to any disclaimer, the term of this patent is extended or adjusted under 35 U.S.C. 154(b) by 715 days.

(21) Appl. No.: 16/330,445

(22) PCT Filed: Sep. 6, 2017

(86) PCT No.: PCT/US2017/050172
§ 371 (c)(1),
(2) Date: Mar. 5, 2019

(87) PCT Pub. No.: WO2018/048832
PCT Pub. Date: Mar. 15, 2018

(65) Prior Publication Data

US 2021/0293445 A1 Sep. 23, 2021

Related U.S. Application Data

(60) Provisional application No. 62/384,507, filed on Sep. 7, 2016.

(51) Int. Cl.
*F24F 13/14* (2006.01)

(52) U.S. Cl.
CPC ..... *F24F 13/1426* (2013.01); *F24F 13/1486* (2013.01); *F24F 2013/1473* (2013.01)

(58) Field of Classification Search
CPC ..... F24F 13/10; F24F 13/14; F24F 13/1426; F24F 13/1486; F16K 1/22; F16K 1/221;
(Continued)

(56) References Cited

U.S. PATENT DOCUMENTS 1,898,907 A * 2/1933 Smith ..... F16B 41/005 411/128
2,706,656 A * 4/1955 Roubal ..... F16B 43/001 411/301

(Continued)

FOREIGN PATENT DOCUMENTS

SE 470022 B * 10/1993 ..... E05B 15/04
WO WO-2013037416 A1 * 3/2013 ..... F16K 31/602

OTHER PUBLICATIONS

International Search Report for corresponding PCT Application No. PCT/US2017/050172 dated Jan. 12, 2018.
Written Opinion for corresponding PCT Application No. PCT/US2017/050172 dated Jan. 12, 2018.

*Primary Examiner* — Edelmira Bosques
*Assistant Examiner* — Michael James Giordano
(74) *Attorney, Agent, or Firm* — Amster Rothstein & Ebenstein LLP

(57) ABSTRACT

The invention is directed to a handle assembly for rotating a pivot rod attached to a damper within ductwork, for the purpose of controlling the flow of conditioned air therethrough. In particular, the present invention provides a pre-assembled portion of the required parts, thereby reducing the number of steps required for final assembly of the damper handle to the pivot rod, resulting in a significant time savings.

14 Claims, 5 Drawing Sheets

(58) Field of Classification Search
CPC ..... F16K 1/222; F16K 1/224; F16K 1/2261; F16K 31/60; F16K 31/602; F16K 31/607; F16K 35/025; F16K 5/0647; F23L 3/00; F16B 21/10; F16B 37/16; F16B 43/001; F16B 43/025; B25G 1/105; B25G 1/107; B25G 1/007; B25G 3/02; B25G 3/26; E05F 15/678; G05G 1/04; G05G 1/06; G05G 1/086; G05G 1/10; A47J 45/07; A47J 45/071; A47J 45/072; A47J 45/074; A47J 45/075; A47J 45/077
USPC ..... 126/292, 295; 251/308; 16/110.1
See application file for complete search history.

(56) References Cited

U.S. PATENT DOCUMENTS

| | | | | |
|---|---|---|---|---|
| 4,114,506 | A * | 9/1978 | Aimar | F16B 37/00 411/512 |
| 5,806,830 | A | 9/1998 | Alvarez | |
| 6,036,130 | A * | 3/2000 | Tietjen | A01K 89/006 242/256 |
| 6,209,850 | B1 * | 4/2001 | Rafalski | F16K 27/0218 251/308 |
| 7,981,189 | B2 * | 7/2011 | Troxell | B01D 46/2411 55/529 |
| 2010/0197217 | A1 | 8/2010 | Yoskowitz | |

* cited by examiner

HANDLE ASSEMBLY FOR ROTATING A PIVOT ROD ATTACHED TO A DAMPER WITHIN DUCTWORK

CROSS REFERENCE TO RELATED APPLICATIONS

This application is a national phase of PCT application No. PCT/US2017/050172, filed Sep. 6, 2017, which claims priority to U.S. provisional patent application No. 62/384,507, filed Sep. 7, 2016, all of which are incorporated herein by reference hereto.

FIELD OF THE INVENTION

The present invention relates to a handle assembly for rotating a pivot rod attached to a damper within ductwork.

BACKGROUND OF THE INVENTION

It is well known in ducted heating, ventilating or air conditioning systems to provide, at selected locations, regulating damper assemblies for controlling the rate of flow of air or the like through the ducts of the HVAC system. Such known ductwork damper assemblies generally include a damper blade made of sheet metal and dimensioned to conform substantially to the cross-section of the air duct intended for passage of air or the like in a regulated manner. In general, the damper blade has a circular shape and is fitted in a circular air duct of slightly larger diameter to permit pivotal rotation of the damper blade.

With reference to FIG. 1, the damper blade 15 is rotatably attached to a shaft 10 (i.e., pivot rod) which is itself rotatably connected to the duct 16 by bearing-type bushings 12, such that the blade 15 is pivotable within the duct 16 as the shaft 10 is rotated. The ductwork includes an optional U-shaped bracket 14 of sheet metal, attached to the air duct 16 of ductwork by bent feet which can be attached to the ductwork in a known manner such as by spot welds or otherwise. An outer wall 13 of the U-shaped bracket 14 is positioned at the outermost portion of the bracket and includes a central aperture through which one end of the pivot rod 10 extends. One end of the pivot rod 10 extends outwardly from the duct 16 and is pivotally rotatable through a lever 50 or other device, to one of a number of selected angular orientations to control the airflow through the duct 16. Various types of known devices using levers of various types are used to rotate the damper blade 15 and to fix it in a pre-selected angular orientation.

Generally, rotation of the lever 50 causes the damper blade shaft 10 to rotate within the duct 16, and thereby produce corresponding rotation of the damper blade 15. The damper blade 15 may be rotated between an open position where the air duct 16 is in a fully open configuration, allowing air to pass therethrough, and a closed position, whereby the flow of air is blocked, causing it to be diverted in a different direction to a different location.

Various devices have been made to improve the ability to pivot and fix such damper blades to a particular angular orientation within the air duct between fully open and fully closed configurations. For example, various arrangements of levers and wingnut-type locking mechanisms have been incorporated to manually pivot and fix the position of the damper blade. These arrangements however, are cumbersome and time consuming to install during final assembly because of the numerous parts involved.

For example, a known damper handle assembly is shown in FIG. 1, wherein a pivot rod 10 has a generally rectangular cross-section and includes a threaded end 11. The damper handle assembly 80 includes a washer 30, a handle 50, and a wingnut 70. The washer 30 includes a circular rubber pad 31 joined to a circular metal plate 32 along adjacent surfaces, wherein a generally rectangular through hole 33 extends through the center of the washer 30 and is shaped and dimensioned to slide over the pivot rod 10. The handle 50 includes a pivot end 52 also having a generally rectangular through hole 51 that is shaped and dimensioned to slide over the pivot rod 10. The handle 50 includes a free end 53 opposite the pivot end 52. The wingnut 70 includes a threaded hole 71 that is threadably engaged with the threaded end 11 of the pivot rod 10.

As a result of the various parts required, these steps of the final assembly process is time consuming, especially when considering the number of units assembled in a factory by a supplier over the course of time (for example, over the course of one work day). For that reason, even a small time savings, measured in seconds per unit, can quickly add up to a large time savings over the course of a work shift. As time is saved, labor is also saved, thereby increasing the efficiency and profitability of the supplier.

Thus, in view of the inadequacies of the known damper handle assembly, there has been a need for an improved damper handle assembly, and a method of assembling the same, for effectively completing the final assembly steps of a damper handle for ductwork. Such a device would reduce the amount of time required to assemble the known device and method.

The present invention provides a solution to the above problem.

SUMMARY OF THE INVENTION

The present invention is directed to a handle assembly for rotating a pivot rod attached to a damper within ductwork, for the purpose of controlling the flow of conditioned air therethrough. In particular, the present invention provides a pre-assembled portion of the required parts, thereby reducing the number of steps required for final assembly of the damper handle to the pivot rod, resulting in a significant time savings.

The required parts generally include three parts: a wingnut, a handle, and a washer. In a preferred embodiment, the three parts are permanently pre-assembled into a single unit. According to other embodiments of the invention, any two of the three parts are permanently pre-assembled in order to save time when attaching the three parts to the pivot rod. In one such embodiment, the wingnut is permanently attached to the handle, with the washer remaining a separate part that is not part of the pre-assembled configuration. In another such embodiment, the washer is permanently attached to the handle, with the wingnut remaining a separate part that is not part of the pre-assembled configuration.

DETAILED DESCRIPTION OF THE PREFERRED EMBODIMENTS

The present invention will now be described in detail with reference to the drawings.

Figure 1:
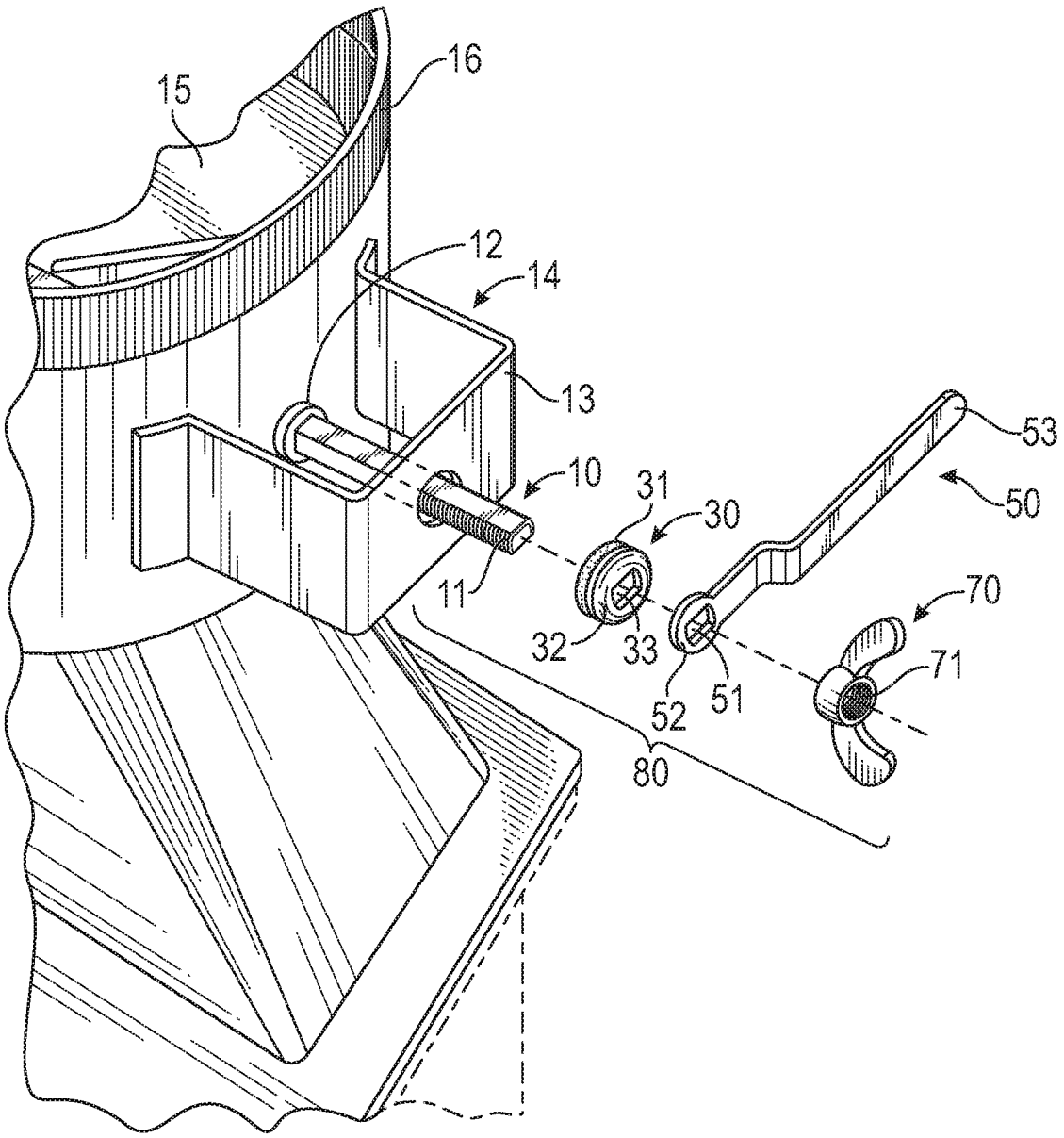
FIG. 1 (Prior Art)
FIG. 1 is an exploded perspective view of a damper handle assembly for ductwork according to the prior art.
Figure 2:
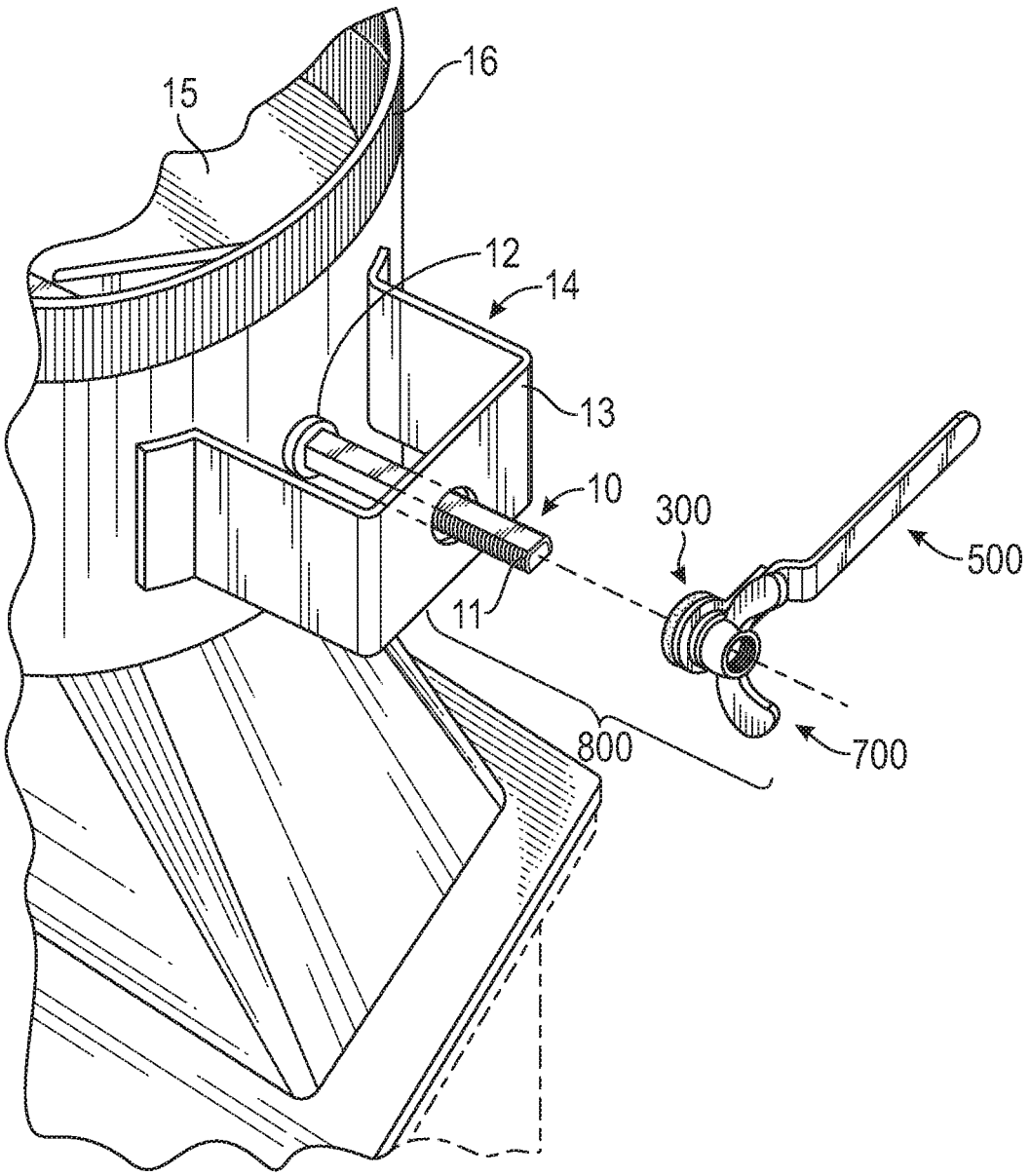
FIG. 2 is an exploded perspective view of a damper handle assembly for ductwork of the present invention.

FIG. 2 is an exploded perspective view of a damper handle assembly 800 for ductwork of the present invention. A pivot rod 10 has a generally rectangular cross-section and includes a threaded end 11. The pivot rod 10 is rotatably connected to a wall of the ductwork via a bushing 12. The ductwork includes an optional U-shaped bracket 14 of sheet metal, attached to the air duct 16 of ductwork by bent feet which can be attached to the ductwork in a known manner such as by spot welds or otherwise. An outer wall 13 of the U-shaped bracket 14 is positioned at the outermost portion of the bracket and includes a central aperture through which one end of the pivot rod 10 extends. The damper handle assembly 800 includes a washer 300, a handle 500, and a wingnut 700. These three parts are pre-assembled to allow them to be threadably connected to the pivot rod 10 in a single step.

Figure 3:
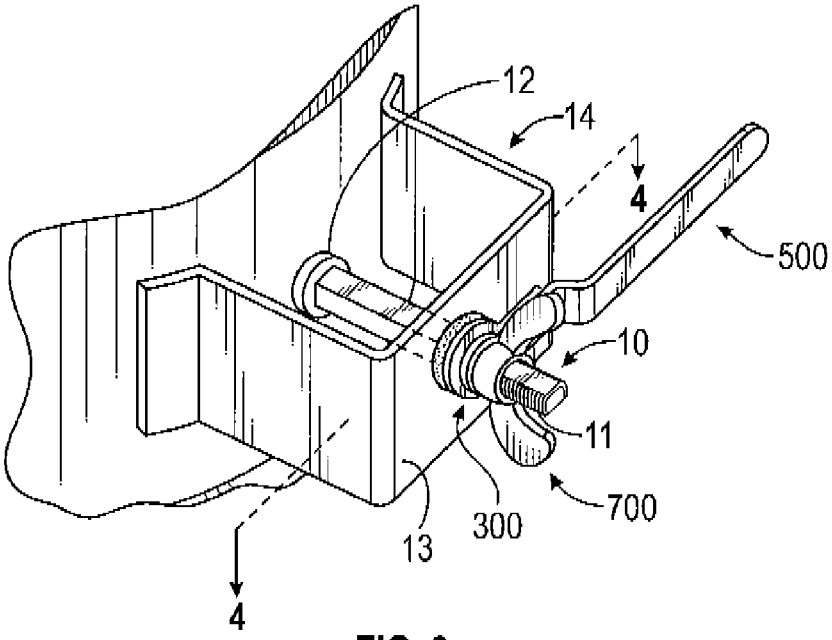
FIG. 3 is a perspective view of the assembly of FIG. 2, after it has been threadably attached to the end of the pivot rod.

FIG. 3 is a perspective view of the assembly of FIG. 2, after it has been threadably attached to the end of the pivot rod 10. In particular, first the entire assembly is slid over the free end of the pivot rod 10 and then the wingnut 700 is threadably engaged with the threaded end 11 of the pivot rod 10. The lever 500 can be locked into a selected position by tightening the wingnut 700 to exert a sufficient clamping force between the outer wall 13 and wingnut 700 to prevent the rotation of the lever 500 because of the frictional engagement thereof.

Figure 4:
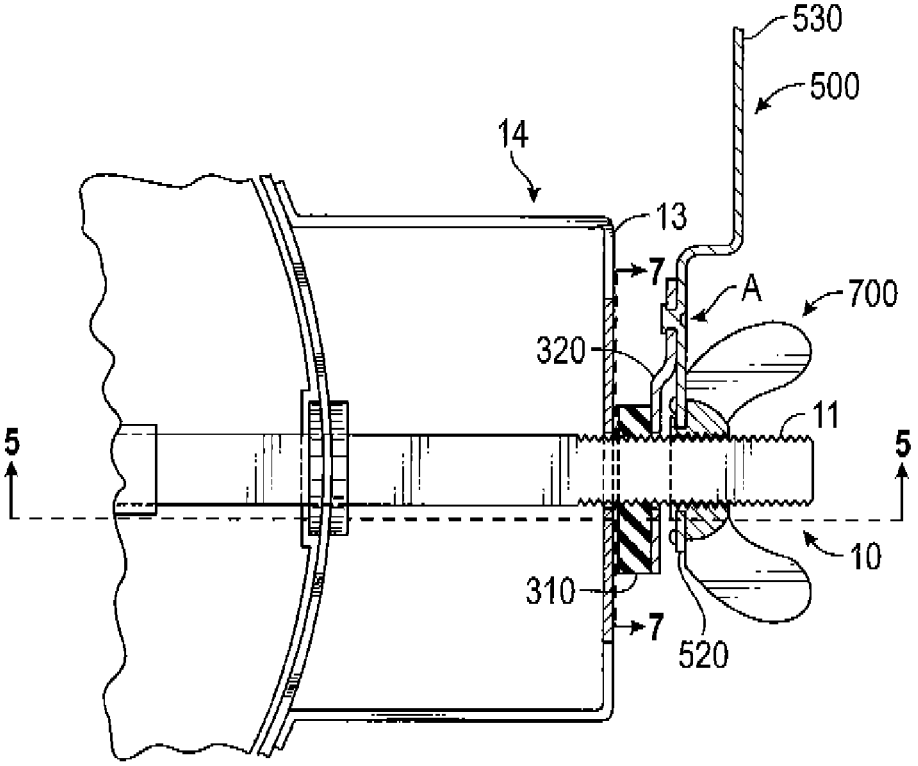
FIG. 4 is a cross-sectional view of the assembly taken in the direction of line 4-4 of FIG. 3.

FIG. 4 is a cross-sectional view of the assembly taken in the direction of line 4-4 of FIG. 3. The washer 300 includes a rubber pad 310 and a metal plate 320. In other embodiments, the pad 310 can be made from any other materials having suitable surface friction and elasticity. In other embodiments, the circular plate 32 is made from any other materials having a suitable rigidity, such as plastic and the like. The rubber pad 310 is joined to a proximal portion of a metal plate 320 along adjacent surfaces via a suitable adhesive material, glue, or the like. A generally rectangular through hole 330 (see FIG. 7) extends through the washer 300 and is shaped and dimensioned to slide over the pivot rod 10. The metal plate 320 of the washer includes a generally circular proximal portion that is joined to a generally rectangular distal portion through a central bent portion forming an offset. The generally rectangular distal portion of the metal plate 320 forms an elongated extension piece that is attached to handle 500 at connection point A. In one embodiment, the metal plate 320 of the washer is permanently attached to the handle 500 by one or more rivets 410 (see FIG. 7). The handle 500 includes a pivot end 520 having a circular through hole 510 (see FIG. 8) that is shaped and dimensioned to slide over the pivot rod 10. The handle 500 includes a free end 530 opposite the pivot end 520. The wingnut 700 includes a threaded hole 710 (see FIG. 8) that is threadably engaged with the threaded end 11 of the pivot rod 10. The wingnut 700 is permanently connected to the pivot end 520 of the handle 500, as explained below.

Figure 5:
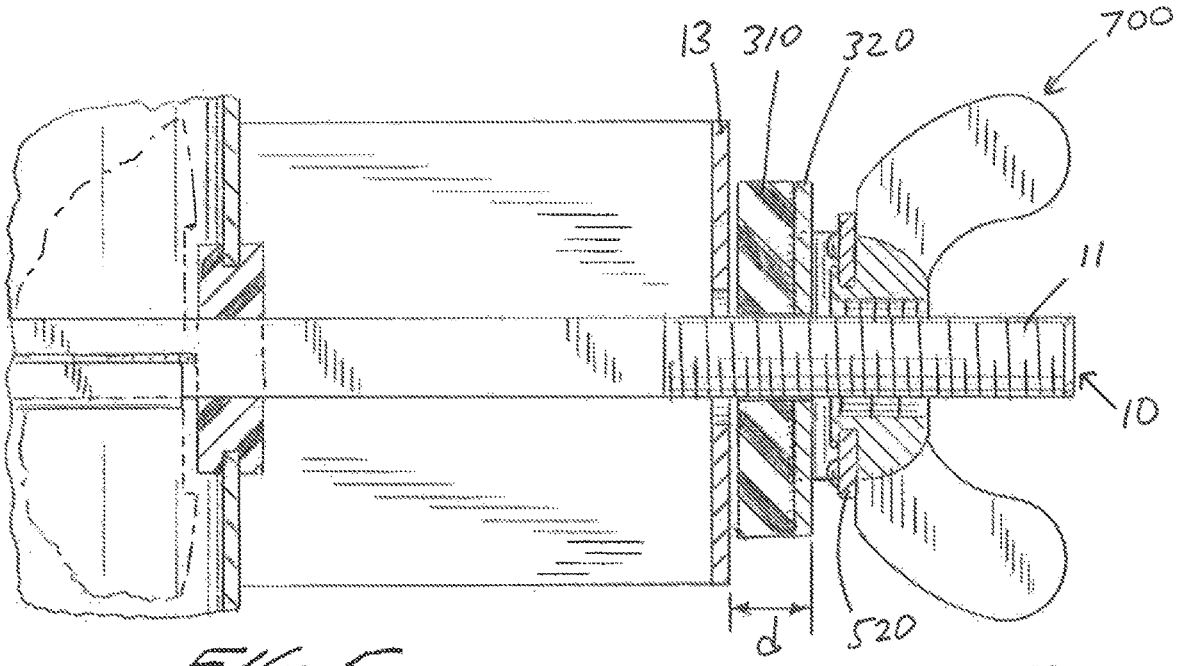
FIG. 5 is a cross-sectional view of the assembly taken in the direction of line 5-5 of FIG. 4.

FIG. 5 is a cross-sectional view of the assembly taken in the direction of line 5-5 of FIG. 4. The rubber pad 310 of the washer contacts the outer wall 13 and the rubber pad 310 becomes compressed as the wingnut 700 is tightened on the threaded end 11 of the pivot rod. Therefore, the rubber pad 310 engages with the outer wall 13 to form a frictional connection to prevent the rotation of the pivot rod 10 after a predetermined amount of compression of the rubber pad 310 is accomplished by tightening the wingnut 700.

Figure 6:
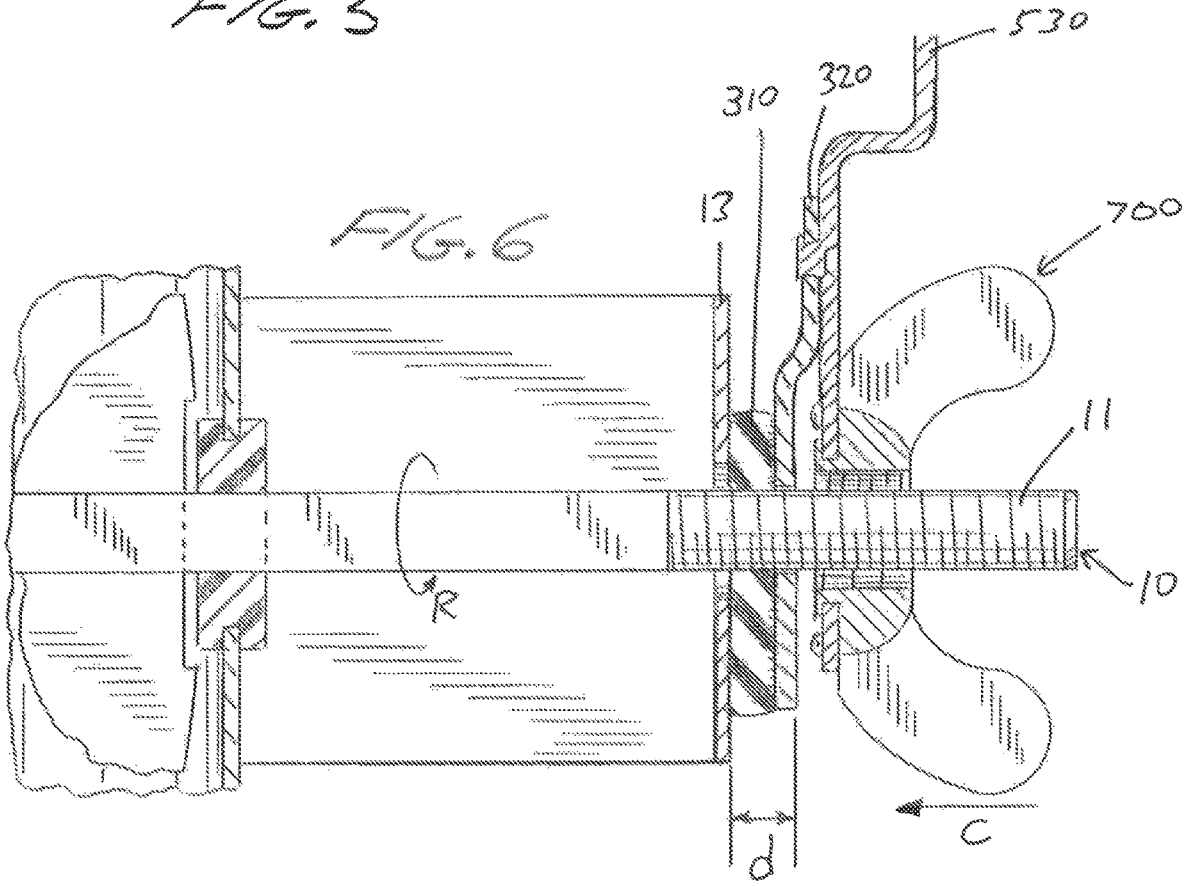
FIG. 6 is a cross-sectional view of the assembly after the free end of the lever is selectively rotated and then the wingnut is tightened to lock the position of the damper.

FIG. 6 is a cross-sectional view of the assembly after the free end 530 of the lever is selectively rotated in direction R and then the wingnut 700 is tightened to lock the position of the damper, as explained above. As the wingnut 700 is tightened, the rubber pad 310 is compressed, and the distance d is decreased.

Figure 7:
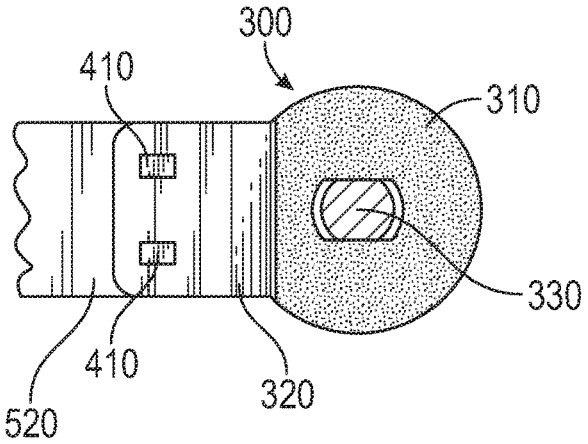
FIG. 7 is a side view of the assembly taken in the direction of line 7-7 of FIG. 4.

FIG. 7 is a side view of the assembly taken in the direction of line 7-7 of FIG. 4. The washer 300 includes a rubber pad 310 that is joined to a metal plate 320 along adjacent surfaces, wherein a generally rectangular through hole 330 extends through the washer 300 and is shaped and dimensioned to slide over the pivot rod 10. In one embodiment, the metal plate 320 is permanently attached to the pivot end 520 of the handle 500 by one or more rivets 410. In other embodiments, the metal plate is attached to the pivot end of the handle by spot welding, gluing, screwing, and the like. In one embodiment, the rubber pad 310 includes a generally circular shape, but with a straight edge at one side that aligns with the proximal end of the central bent portion of the metal plate 320 (see FIG. 4).

Figure 8:
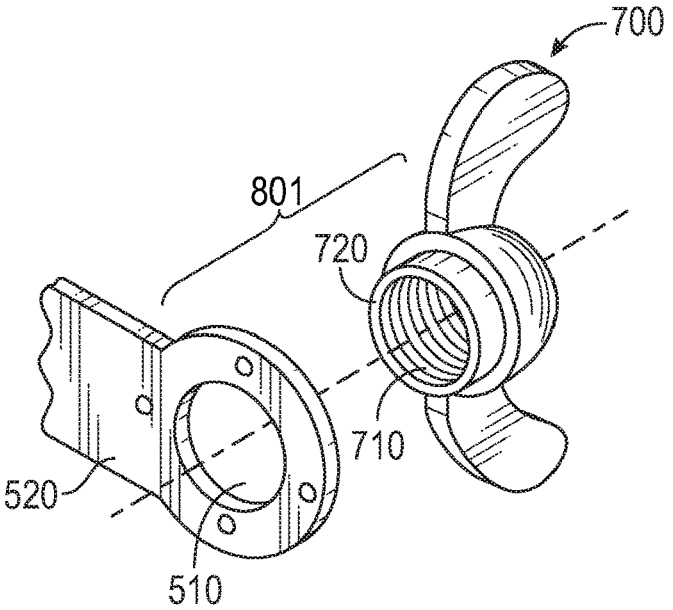
FIG. 8 is an exploded perspective view of the wingnut before it is permanently attached to the pivot end of the handle.

FIG. 8 is an exploded perspective view of the wingnut 700 before it is permanently attached to the pivot end 520 of the handle. The wingnut 700 includes a cylindrical tail 720 that is dimensioned to slide into the circular through hole 510 that is formed in the pivot end 520 of the handle. In one embodiment, the cylindrical tail 720 is formed by milling down the end of a wingnut along its outer surface.

Figure 9:
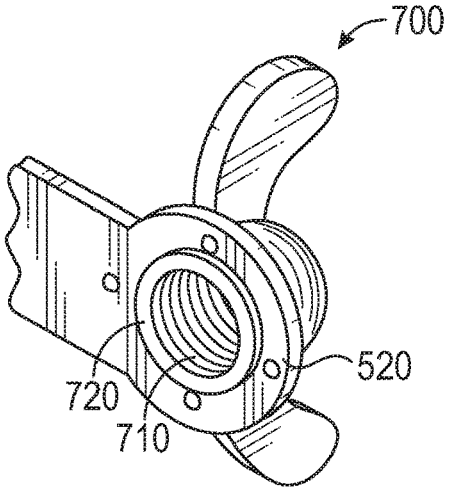
FIG. 9 is a perspective view of the wingnut after it is permanently attached to the pivot end of the handle.

FIG. 9 is a perspective view of the wingnut 700 after it is permanently attached to the pivot end 520 of the handle. First, the cylindrical tail 720 is inserted through the through hole 510 of the handle as far as possible. Next, the cylindrical tail 720 is flared over the outside of the opening 510 of the pivot end 520 of the handle by smashing the cylindrical tail 720. Therefore, the flared end of the cylindrical tail permanently attaches the wingnut 700 to the pivot end 520 of the handle, while at the same time allowing for unrestricted rotation of the wingnut 700 relative to the pivot end 520 of the handle.

The damper handle assembly of the present invention provides a pre-assembled configuration of the required parts, thereby reducing the number of steps required for final assembly of the damper handle to the pivot rod, resulting in a significant time savings.

The required parts generally include three parts: a wingnut, a handle, and a washer. In a preferred embodiment, the three parts are permanently pre-assembled into a single unit as described above. According to other embodiments of the invention, any two of the three parts are permanently pre-assembled in order to save time when attaching the three parts to the pivot rod. In one such embodiment, the wingnut is permanently attached to the handle, with the washer remaining a separate part that is not part of the pre-assembled configuration. In another such embodiment, the washer is permanently attached to the handle, with the wingnut remaining a separate part that is not part of the pre-assembled configuration.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

The invention claimed is:

1. A handle assembly for rotating a pivot rod attached to a damper within ductwork comprising:

a. a washer having a first through hole being adapted to be slidably inserted over the pivot rod;

b. a handle having a pivot end and a free end, wherein the handle is adapted for rotating the pivot rod, wherein the handle is permanently attached to the washer; and c. wingnut permanently attached to the pivot end of the handle, wherein the wingnut is threadedly engageable with the pivot rod and fixed in position relative to the handle in a direction defined by a pivot axis of the pivot rod.

2. The handle assembly of claim 1, wherein the pivot end of the handle has a second through hole being adapted to be slidably inserted over the pivot rod.

3. The handle assembly of claim 2, wherein the second through hole is configured and dimensioned to correspond with a cross-sectional shape of the pivot rod so that rotation of the handle causes simultaneous rotation of the pivot rod.

4. The handle of claim 1, wherein the washer comprises:

a. a plate; and b. a pad being joined to a proximal portion of the plate.

5. The handle of claim 4, wherein the plate includes a distal portion which is permanently attached to the handle.

6. The handle of claim 5, wherein the plate is permanently attached to the handle via at least one rivet.

7. The handle of claim 5, wherein the metal plate includes a central bent portion positioned between the first through hole and the distal portion.

8. The handle of claim 4, wherein the pad is made from rubber.

9. The handle of claim 8, wherein the rubber pad includes a proximal frictional surface for engagement with a wall of the ductwork.

10. The handle of claim 2, wherein before assembly the wingnut includes a cylindrical tail, and wherein after assembly the cylindrical tail extends through the second through hole and is flared over the second through hole for achieving a permanent attachment thereof.

11. The handle of claim 1, wherein the wingnut has a threaded hole for threadedly engaging with the pivot rod.

12. A handle assembly for rotating a pivot rod attached to a damper within ductwork comprising the following three parts:

a. a washer having a through hole being adapted to be slidably inserted over the pivot rod;

b. a handle having a pivot end and a free end, wherein the handle is adapted for rotating the pivot rod; and c. a wingnut, wherein the wingnut is threadedly engageable with the pivot rod; and wherein any two of the three parts are permanently pre-assembled in order to save time when attaching the three parts to the pivot rod.

13. The handle assembly of claim 12, wherein the washer is permanently attached to the handle.

14. The handle assembly of claim 12, wherein the handle is permanently attached to the wingnut.

* * * * *